United States Patent [19]

Panzzolo

[11] Patent Number: 4,872,549

[45] Date of Patent: Oct. 10, 1989

[54] CARRIER FOR BOTTLES

[75] Inventor: Aldo Panzzolo, Perrysburg, Ohio

[73] Assignee: Owens-Illinois Plastic Products Inc., Toledo, Ohio

[21] Appl. No.: 834,133

[22] Filed: Feb. 24, 1986

Related U.S. Application Data

[63] Continuation of Ser. No. 663,651, Oct. 22, 1984.

[51] Int. Cl.[4] ..... B65D 75/00

[52] U.S. Cl. ..... 206/158; 206/199; 206/148

[58] Field of Search ..... 206/141, 142, 148, 149, 206/151, 157, 158, 194, 199; 215/252, 253; 294/87.2, 87.28

[56] References Cited

U.S. PATENT DOCUMENTS

| | | | |
|---|---|---|---|
| 2,650,128 | 8/1953 | Failor | 294/87.2 |
| 3,317,234 | 5/1967 | Burford | 294/87.2 |
| 3,674,137 | 7/1972 | Graser | 206/158 |
| 3,912,075 | 10/1975 | Berry | 206/158 |
| 3,926,307 | 12/1975 | Klygis | 294/87.2 |
| 4,139,094 | 2/1979 | Berry et al. | 206/158 |
| 4,206,851 | 6/1980 | Ostrowsky | 215/252 |
| 4,316,538 | 2/1982 | Manizza | 206/158 |
| 4,332,325 | 6/1982 | Manizza | 206/158 |
| 4,360,231 | 11/1982 | Bolin | 206/158 |
| 4,369,889 | 1/1983 | Ostrowsky | 215/246 |
| 4,407,422 | 10/1983 | Wilde et al. | 215/246 |
| 4,453,630 | 6/1984 | Helms et al. | 206/158 |
| 4,457,426 | 7/1984 | Humphries | 206/158 |
| 4,465,180 | 8/1984 | Klygis | 206/151 |
| 4,487,312 | 12/1984 | Heider | 206/158 |
| 4,523,677 | 6/1985 | Schurmann | 206/151 |
| 4,530,436 | 7/1985 | Wiedmer | 215/246 |

FOREIGN PATENT DOCUMENTS

| | | | |
|---|---|---|---|
| 2068858 | 8/1971 | France | 294/87.2 |
| 168467 | 9/1971 | Netherlands | 206/141 |
| 2076773 | 12/1981 | United Kingdom | 206/141 |

OTHER PUBLICATIONS

Model of Patent No. 4,453,630 Showing the Photocopied Upper Wall.

*Primary Examiner*—David T. Fidei

[57] ABSTRACT

An improved single piece plastic carrier for a plurality of filled and capped bottles in which the neck of each bottle to be carried by the carrier is received in an aperture in the top panel of the carrier and is supported by spaced apart tabs which extend radially inwardly from the aperture. Each such tab has a substantially greater arcuate extent than the tabs utilized in prior art carriers, and each such tab, therefore, is substantially less yieldable than such prior art tabs. The substantially reduced tab yieldability is particularly advantageous when the carrier is used in conjunction with bottles that are capped with tamper-indicating molded plastic closures, especially closures with a tamper-indicating band of the heat shrinkable type, because it will help to prevent the tab from being deflected upwardly under the tamper-indicating band, which could lead to the fracture of the band prior to any attempt to open the band. The invention can be used to advantage in the packaging of single service carbonated beverage bottles which are capped with 28 mm closures of the aforesaid type, and six-bottle and four-bottle versions of such a carrier are described.

3 Claims, 4 Drawing Sheets

CARRIER FOR BOTTLES

This is a continuation of application Ser. No. 663,651, filed Oct. 22, 1984.

BACKGROUND OF THE INVENTION

1. Field of the Invention

This invention relates to an improved semi-rigid plastic carrier for carrying a plurality of filled and capped glass or plastic bottles from the upper portions thereof. More particularly, this invention relates to an improved carrier of the aforesaid type which may be used to advantage when the bottles are capped with thermoplastic closures.

2. Description of Related Prior Art

U.S. Pat. No. 4,139,094 describes a semi-rigid plastic carrier for carrying a plurality of filled and capped glass or plastic bottles from the upper portions thereof. In such a carrier each bottle is retained by a circular array of yieldable tabs that engage the underside of the cap of the bottle to retain the bottle in the carrier until such time as a user desires to remove the bottle by pulling it through the array of tabs. Each bottle receiving opening of the carrier of the aforesaid U.S. patent is shown as having four of such tabs with adjacent tabs being separated by an enlarged space whose inside diameter exceeds the outer diameter of the closure to be inserted in such opening, and with the width of each such space being almost as great as the width of the inside edge of each of the tabs which it separates. Carriers of the aforesaid type have been widely used in the packaging of filled bottles which are capped with 28 mm aluminum roll-on closures of the various types which have been widely utilized in the beverage industry for the past several years. See, for example, U.S. Pat. Nos. 3,601,273 (Kutcher) and 4,007,851 (Walker).

SUMMARY OF THE INVENTION

In recent years the beverage bottling industry has shown an interest in substituting molded thermoplastic closures for aluminum roll-on closures in the packaging of certain beverages in glass or plastic bottles, especially those beverages which develop internal pressure when packaged in a sealed bottle due to the presence of carbonation in the beverage. While there are a variety of types of such thermoplastic closures in usage, see, e.g., U.S. Pat. No. 4,458,821, such closures are usually characterized by the presence of an integrally formed frangible tamper-indicating band at the bottom edge of the closure, and when such a band is utilized, it is desired that it remain intact until the first attempt to open the bottle, whereupon it should tear or break to give a visual indication of the fact that the bottle has been opened.

The yieldable tabs of carriers of the type shown in U.S. Pat. No. 4,139,094 perform quite well when used in the packaging of bottles that are capped with aluminum roll-on closures. However, it has been noted that these tabs, because of their yieldability, can become wedged under the tamper-indicating bands of certain types of thermoplastic beverage closures during the application of the carriers or in transit, and can break or fracture these fragile bands by the spring action of the tabs prior to the initial opening of the bottle, especially in the case of closures with tamper-indicating bands of the heat shrinkable type. This result is undesirable, of course, because it can falsely suggest to a consumer that the bottle has previously been subject to an opening attempt, and this may result in the unnecessary disposal of a beverage which is safe for consumption, and to the possible filing of an unnecessary warranty or other claim in connection therewith.

In accordance with the present invention it has been found that carriers of the type shown in U.S. Pat. No. 4,139,094 can be adapted for use with bottles capped with tamper-indicating plastic closures by constructing the bottle retaining tabs of the carrier to be substantially less yieldable than the carrier tabs of such U.S. patent, in order to prevent such tabs from deflecting upwardly under the tamper-indicating band of the closure on the container retained therein. While, of course, the reduction in the yieldability of the tabs of the carrier of U.S. Pat. No. 4,139,094 could be accomplished by utilizing a substantially heavier sheet of plastic in the fabrication of the carrier, the added thickness and weight of the plastic material used in such a carrier would add considerably to the cost thereof, and would detract from the economic advantages in the use of such carriers relative to wrap-around paperboard carriers or other types of carriers. The required substantial increase in tab yieldability can be obtained, it has been found, without the need to materially increase the thickness of the carrier sheet material, or without the need to utilize a materially stiffer type of thermoplastic material to form the sheet, by a redesign of the bottle engaging tabs of the carrier to make the arcuate extent of each tab substantially greater than its counterpart in the prior art carriers. This can be done by reducing the number of the bottle-engaging tabs in each circular array thereof and by reducing the arcuate extent of the spaces which separate adjacent tabs in the array.

Accordingly, it is an object of the present invention to provide an improved carrier for carrying a plurality of filled and capped bottles from the upper portions thereof, and it is a corresponding object to provide a package comprising a plurality of filled and capped bottles and an improved carrier which engages the upper portions of such bottles.

More particularly, it is an object of the present invention to provide a carrier for carrying a plurality of filled bottles which are capped with tamper-indicating thermoplastic closures from the upper portions of such bottles, and it is a corresponding object to provide a package comprising a plurality of filled bottles which are capped with tamper-indicating thermoplastic closures and an improved carrier which engages the upper portions of such bottles immediately below the closures thereon.

For a further understanding of the present invention and the objects thereof, attention is directed to the drawing and the description thereof, to the detailed description of the invention and to the appended claims.

DETAILED DESCRIPTION OF THE INVENTION

Figure 1:
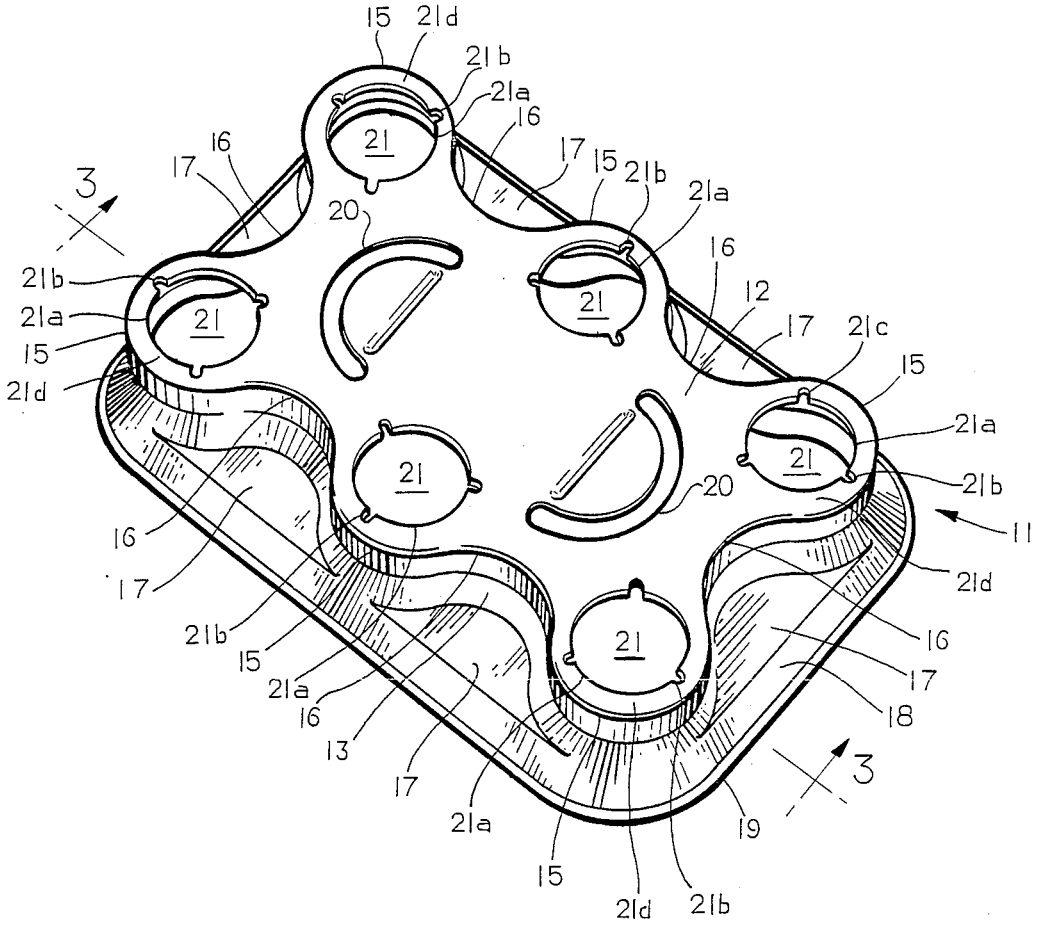
FIG. 1 is a perspective view of an embodiment of a carrier in accordance with the present invention.
Figure 2:
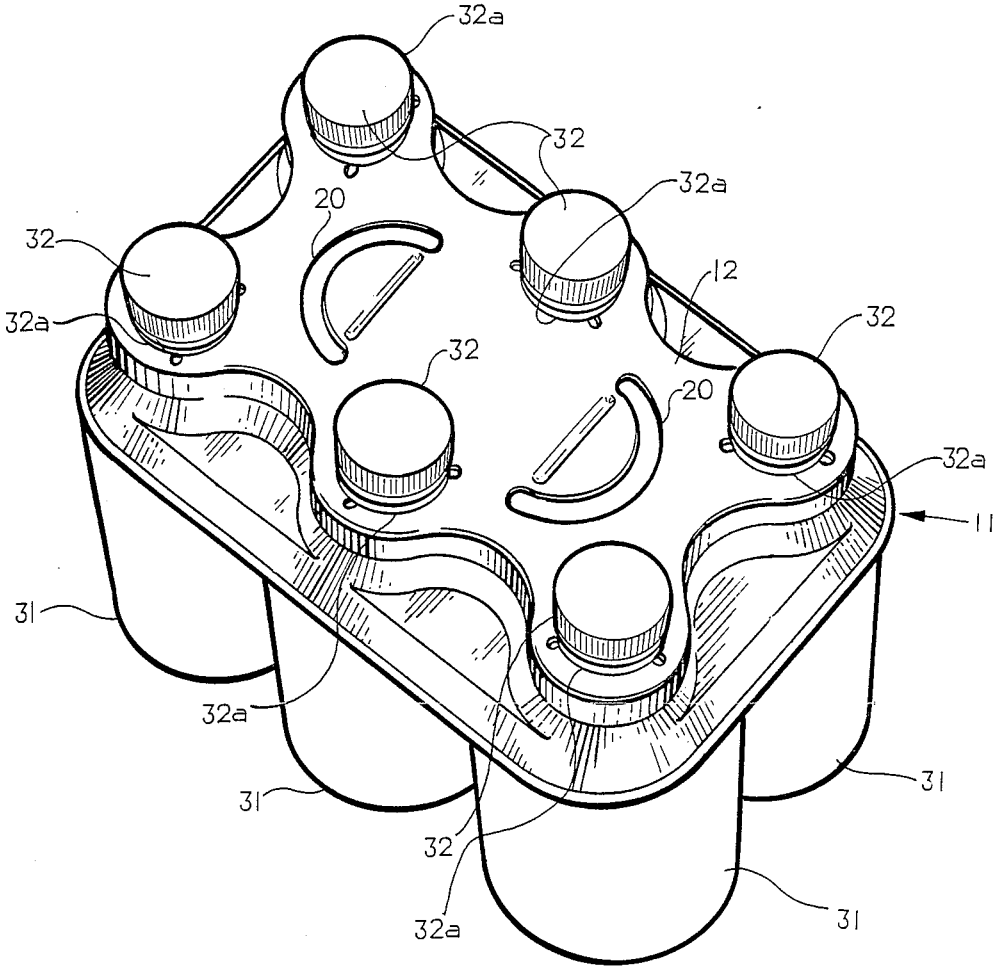
FIG. 2 is a perspective view of the carrier of FIG. 1 after its application to a plurality of filled and capped bottles.
Figure 3:
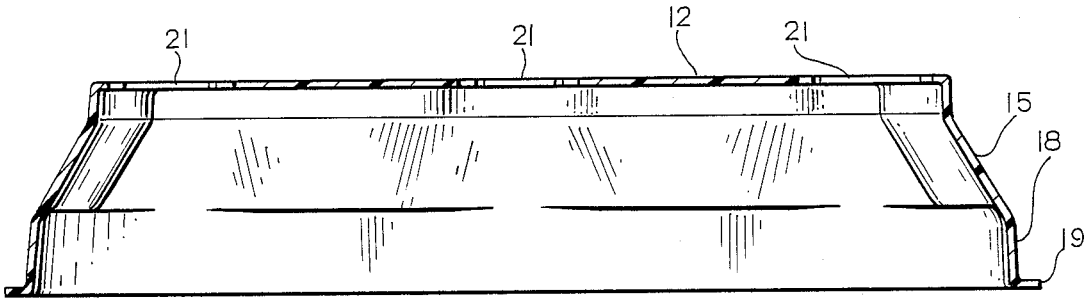
FIG. 3 is a sectional view taken on line 3—3 of FIG. 1.

FIG. 1 illustrates a unitary carrier, generally indicated by reference numeral 11, which may be formed in a single piece from a sheet of a suitable semi-rigid thermoplastic material by a process which includes a thermoforming operation to shape the sheet into the illustrated complex three-dimensional shape. As is shown in FIG. 2, carrier 11 is designed to be applied to a plurality of filled and capped beverage bottles 31, the cap of each of such bottles being identified by reference numeral 32. Carrier 11 may be dimensionally designed to be used with any of the popular sizes and types of bottles used in the packaging of single service quantities of a beverage, e.g., 16 oz. glass bottles, and a suitable carrier for such 16 oz. glass beverage bottles can be formed from a sheet of high density polyethylene of approximately 25 mil (0.025 in.) sheet thickness.

Carrier 11 comprises a top panel 12 and a peripheral wall 13 extending from and along the periphery of top panel 12, and peripheral wall 13 comprises plural outwardly convex arcuate first wall portions 15 and plural outwardly concave second wall portions 16, each of which is disposed between a pair of adjacent first wall portions 15. By this arrangement first wall portions 15 and second all portions 16 blend in a continuous manner to define plural internal compartments for containers. Carrier 11 also comprises a plurality of ledges 17 extending outwardly from the second wall portions 16, and a peripheral skirt 18 which depends downwardly from ledges 17 and from first wall portions 15. Peripheral skirt 18, at its lower margin, merges into a lip 19 which extends outwardly therefrom.

Figure 4:
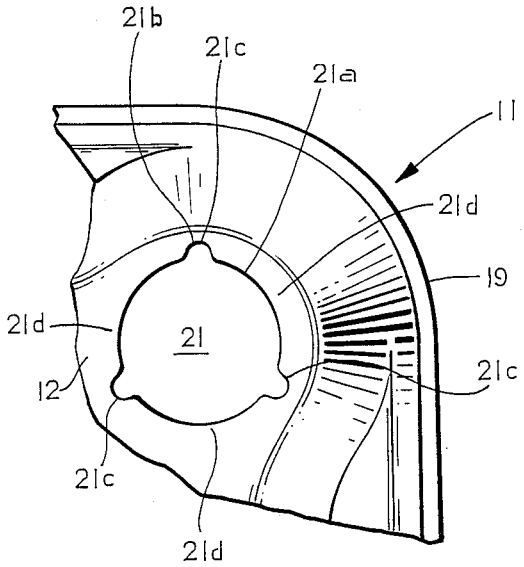
FIG. 4 is an enlarged fragmentary plan view of the carrier of FIG. 1.

The top panel 12 of carrier 11 is provided with a plurality of irregularly-shaped but generally circular bottle neck receiving apertures 21. The inside diameter **21*a* of each aperture 21 is sized to provide an interference fit with the bottom of the closure 32 of a bottle neck which is inserted through the aperture, as is shown in FIG. 2, and the outside diameter 21*b* of the aperture is sized to provide a clearance fit with such bottle closure. As is shown in FIGS. 1 and 4, each aperture 21 comprises a plurality of narrow spaced-apart slots 21*c*. Slots 21*c* open into the inside diameter 21*a* of the aperture and extend to its outside diameter 21*b*, and form a plurality of tabs 21*d* which extend between the slots 21*c*** on either side thereof.

For any given bottle closure size tabs **21*d* will be considerably wider than their counterparts in the carrier of U.S. Pat. No. 4,139,094 because of the fact that slots 21*c* are considerably narrower and because, as shown, there are only three such tabs in each aperture as opposed to four tabs in the bottle receiving holes of the aforesaid U.S. patent. Each tab 21*d*, therefore, will be considerably less capable of yielding upwardly with respect to the bottom of the closure which is positioned adjacent thereto. Thus, when closure 32 is of the type which comprises a fragile tamper-indicating band 32*a* disposed at the bottom margin thereof, as shown in FIG. 2, the added rigidity of each tab 21*d* will help to prevent it from yielding or deflecting upwardly under the bottom edge of the closure. This, in turn, will help to prevent the tab from fracturing the tamper-indicating band 32*a***, if and when it becomes dislodged from a position thereunder by the residual springiness of the tab.

Like the carrier in the aforesaid U.S. Pat. No. 4,139,094, carrier 11 is provided with a pair of finger receiving apertures 20 in top panel 12 to permit the user to conveniently carry the package consisting of carrier 11 and the bottles 31 contained therein. This will permit the carrier to be picked up repeatedly throughout its life from the bottling plant to the household of a consumer, and when a properly designed carrier is properly applied to the associated bottles, they will remain securely engaged by the carrier throughout this cycle until someone decides to remove the bottles or any of them therefrom.

Bottles 31 of the type typically carried by a carrier 11 of the type illustrated are of the single service type, e.g., bottles which are designed to contain 10 oz. or 16 oz., currently two very popular bottle sizes, and they are generally provided with a 28 mm closure-receiving finish portion. When used in conjunction with 28 mm molded thermoplastic closures on such single service bottles, a carrier formed from a 25 mil thick sheet of high density polyethylene will function quite well when the apertures 21 are equipped with three tabs **21*d* This can be accomplished by constructing aperture 21 with an outside diameter 21*b* of 1.312 inch and an inside diameter 21*a* of 1.020 inch and by constructing slots 21*c*** in the form of segments of circles with radii of 0.093 inch. Two tab versions of such 25 mil carriers for bottles with 28 mm plastic closures, on the other hand, were found to be too strong and caused band breakage upon removal of the bottles.

Figure 5:
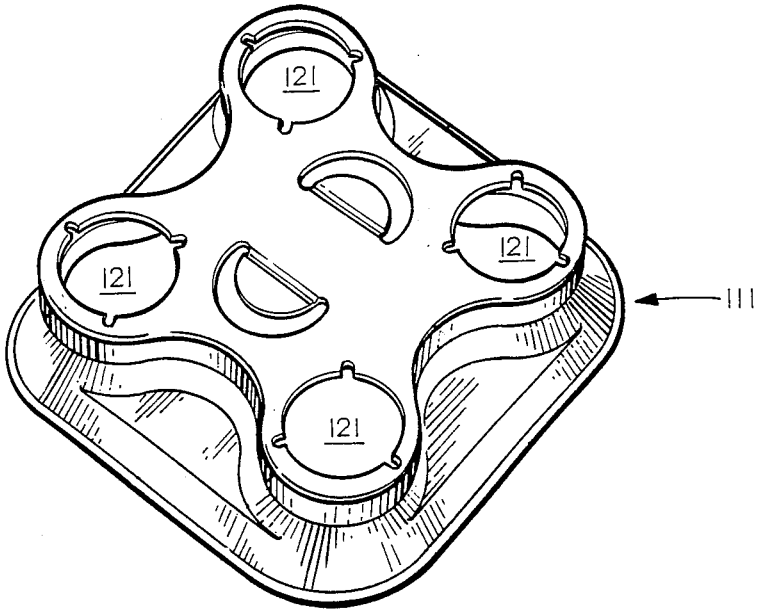
FIG. 5 is a perspective view of an alternative embodiment of a carrier in accordance with the present invention

FIG. 5 illustrates an alternative embodiment of a carrier, indicated generally by reference numeral 111, which is designed for the packaging of four single service bottles and provided, therefore, with four bottle receiving apertures 121. Except for the number of filled and capped bottles to be packaged in carrier 111, it may be considered to be the same in construction as carrier 11 of the embodiment of FIGS. 1–4, and when designed for use with single service bottles it may also be advantageously formed from high density polyethylene of approximately 25 mil thickness. The dimensional characteristics of apertures 121 may, therefore, be identical to those of apertures 21 of carrier 11 when used with bottles and closures of the same type. Similarly, the present invention may be utilized in conjunction with carriers designed to package other quantities of bottles, and an eight-bottle carrier may be especially suitable when used in the packaging of smaller, e.g. 7 oz. or 10 oz., single service bottles.

The best mode known to me to carry out this invention has been described above in terms sufficiently full, clear, concise and exact as to enable any person skilled in the art to make and use the same. It is to be understood, however, that it is within my contemplation that certain modifications of the above-described mode of practicing the invention can be made by a skilled artisan without departing from the scope of the invention and it is, therefore, desired to limit the invention only in accordance with the appended claims.

What is claimed is:

1. A package comprising, in combination:

a plurality of filled and capped bottles, each of said bottles being capped with a molded thermoplastic closure that is provided with a tamper-indicating band on the underside thereof, said tamper-indicating band being of the heat-shrinkable type; and a unitary carrier supportably receiving the upper portions of said bottles to permit the carrying of said bottles from said upper portions said carrier being formed from a sheet of a semi-rigid thermoplastic material by thermoforming and further comprising:

a top panel, said top panel being disposed adjacent said underside of said molded thermoplastic closure of each of said filled and capped bottles;

wall means extending downwardly from said top panel to surround said upper portions of said bottles; and a plurality of generally circular apertures located in said top panel, each of said generally circular apertures receiving the neck of a bottle and comprising a maximum of three tabs extending radially inwardly from the periphery of said aperture, said tabs extending in a generally circular array around said aperture to support the bottle received in said aperture from the underside of said closure, said tabs being spaced apart from one another, the arcuate extent of each of said tabs being substantially greater than the arcuate extent of the space between adjacent tabs, said arcuate extent of each of said tabs being sufficient to prevent said tab from deflecting upwardly under said tamper-indicating band of said closure prior to any attempt to remove said bottle from said aperture of said unitary carrier.

2. A package according to claim 1 wherein each of said apertures of said unitary carrier comprises three of said tabs and wherein said molded thermoplastic closure is a 28 millimeter closure.

3. A package according to claim 1 wherein each of said bottles contains not substantially more than 16 oz. of product therein, said carrier being formed from a sheet of high density polyethylene that is not substantially greater than 0.025 inch.

* * * * *